United States Patent [19]

Walker

[11] 4,130,294

[45] Dec. 19, 1978

[54] COLLAPSIBLE SKI POLE SEAT

[76] Inventor: Laurine L. Walker, 2210 Nome St., Aurora, Colo. 80010

[21] Appl. No.: 806,488

[22] Filed: Jun. 14, 1977

[51] Int. Cl.[2] ..... A63C 11/22

[52] U.S. Cl. ..... 280/11.37 E; 248/155.1

[58] Field of Search ..... 280/11.37 E, 11.37 B; 248/155.1, 155.2

[56] References Cited

U.S. PATENT DOCUMENTS

| | | | |
|---|---|---|---|
| 2,445,344 | 7/1948 | Wachtel | 280/11.37 E |
| 2,473,158 | 6/1949 | Luekens | 280/11.37 E |
| 2,800,164 | 7/1957 | Chambers | 248/155.1 |
| 3,179,436 | 4/1965 | Choy | 280/11.37 E |

*Primary Examiner*—Joseph F. Peters, Jr.
*Assistant Examiner*—Gene A. Church
*Attorney, Agent, or Firm*—W. Britton Moore

[57] ABSTRACT

A two-part ski pole including upper and lower tubular shaft sections with a snow pad above the pointed lower end of the lower section. Arranged at the upper end of the lower shaft section and supported for collapsible folding position relative thereto is a circular flexibly rimmed fabric seat adapted to be housed and concealed within the upper shaft section when collapsed. Sleeved removal of the upper shaft section permits unfolding and expansion of the flexible seat for skier supporting use.

7 Claims, 6 Drawing Figures

COLLAPSIBLE SKI POLE SEAT

This invention relates to a two-part ski pole having a collapsible circular flexibly rimmed fabric seat foldably arranged at the upper end of the lower pointed section thereof and housable within the upper section of the pole when the latter is sleeved thereover.

While it has heretofore been proposed to provide ski poles with seat members so that a skier may rest thereon, such as U.S. Pat. Nos. to Wood 2,257,831, Wachtel 2,445,344, Osmun 2,834,604, and Choy 3,179,436, these prior art poles are rigid and of the usual length and the seats assembled thereon are cumbersome and impractical for use in that they are unwieldly and add such seight to the poles that they cannot be used with ease in skiing.

The principal object of the present invention resides in providing a two-part ski pole wherein the lower pointed shaft section has a snow pad thereon and is provided with a circular flexibly rimmed fabric seat attached to foldable struts and storable and concealed within the upper section of the pole when sleeved over the lower section, with the seat being unfoldable and expandable to seating position upon removal of the upper section.

Another object is the provision of a two-part ski pole wherein the lower section has a foldable and collapsible fabric seat thereon expandable upon removal of the upper section, so that the skier may sit thereon and be supported thereby, during which the other conventional rigid ski pole may be employed as a prop.

Still another object is the provision of a two-part ski pole having a collapsible fabric seat at the upper end of the pointed lower section which is housable and concealable when collapsed within the upper section.

A further object is to provide a relatively light two-part ski pole which is streamlined and useable with a conventional rigid pole for normal skiing use, and yet, when the upper section is removed from the lower section, permits of the use of the latter for seating purposes with the other pole serving as a prop.

A still further object is the provision of a two-part ski pole wherein a collapsible circular flexibly rimmed fabric seat is foldably supported by space struts at the upper end of the lower section so as to be housed within the upper section when the struts are foldable inwardly against the pole.

These and other objects and advantages will be apparent as the specification is considered with the accompanying drawings, wherein.

Figure 1:
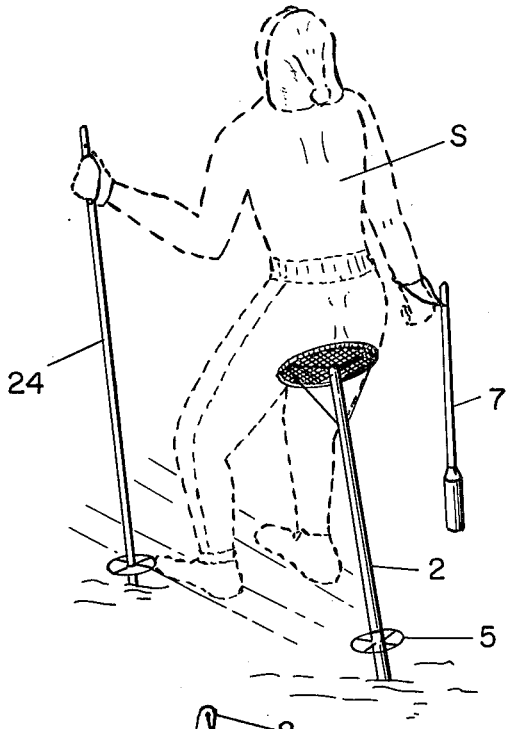
FIG. 1 is a perspective view of the present ski pole in seating use when the upper section has been removed and the seat has been unfolded to seating position, with added support or balance from the other ski pole.

Referring more particularly to the drawings, wherein similar reference numerals designate like parts throughout the several views, numeral 1 generally indicates a tubular two-part ski pole preferably of some suitable light metal, such as aluminum, including a lower section 2 with a tapered pointed lower end 3. A snow pad 4, of conventional construction, including a ring 5 is connected by thongs or bands 6 to an axial collar, not shown, on the lower section above the pointed end 3 thereof. A tubular upper section 7 is formed with a hand gripping upper portion 8 having a wrist engaging looped thong 9. The lower/tubular end of upper section 7 is enlarged, as at 10, and is sleevably arranged over the upper end of lower section 2, for a purpose presently to be described.

A circular seating disc 11 of some suitable flexible fabric or plastic mesh material having a reinforced rim 12 is arranged at the open upper tubular end 13 of lower section 2. The disc 11 is large enough in diameter to extend sufficiently beyond section 2, when in the open position of FIG. 4, to provide a seat for a skier S. The fabric is open at its center and secured to a ring 14, smaller in diameter than the inside diameter of section 2, and three spaced struts 15 are suitably hinged, as at 16, to rim 12 and to ring 14, as at 17. Three additional supporting struts 18 are hinged to the outer ends of struts 15 and extend inwardly and downwardly toward pole section 2, where the ends are hinged, as at 21, to the lower ends of three elongated slots or keyways 20 in section 2 and extending to the upper end thereof.

Figure 3:
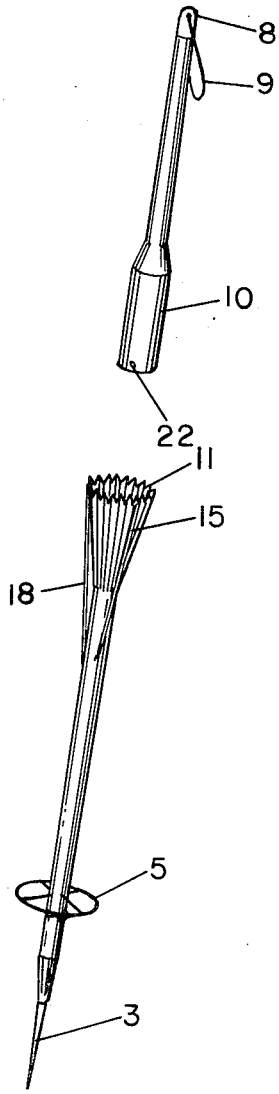
FIG. 3 is a side elevation with the upper ski pole section removed and with the collapsible seat on the lower section partially unfolded.
Figure 4:
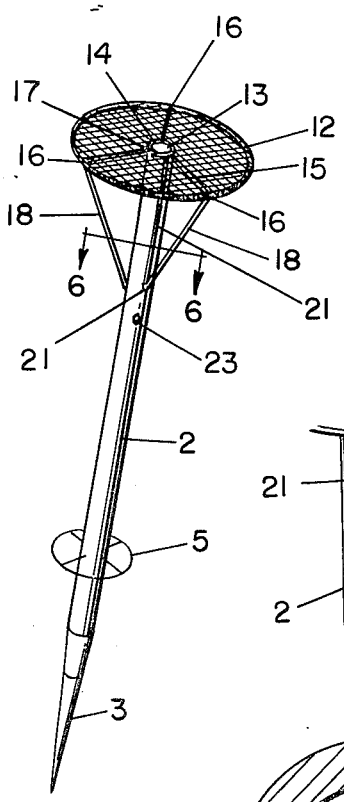
FIG. 4 is a perspective view of the lower ski pole section with the fabric seat unfolded and being supported in seating position by its struts.
Figure 5:
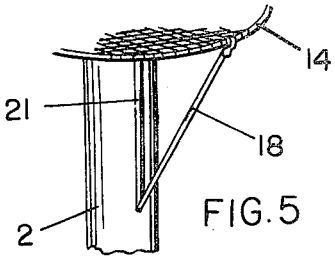
FIG. 5 is a partial elevation of the upper end of the lower pole section showing the fabric seat in seating position, and one of its supporting struts in operative position.
Figure 6:
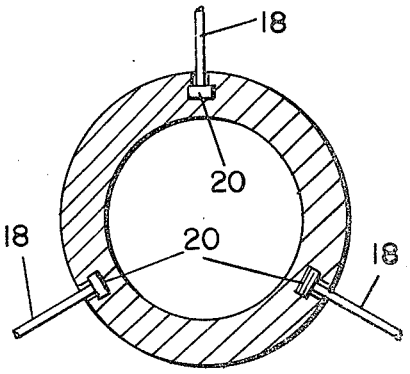
FIG. 6 is a section on the line 6—6 of FIG. 4.

By virtue of this arrangement, it will be apparent that downward and inward pressure against struts 15 and 18 causes the fabric disc 11 to collapse or fold upwardly, from the FIG. 4 open or expanded position, towards that of FIG. 3, and thereafter until it is alined with and partially stored within the lower section 2. When so folded or collapsed, the struts will extend longitudinally into the slots 21.

Figure 2:
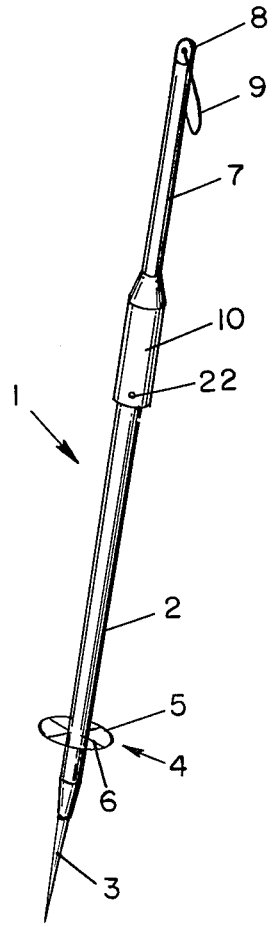
FIG. 2 is a side elevation of the ski pole in assembled unitary position for normal use in skiing.

In the inactive or stored position of seating disc 11, the struts will be received within slots 21, and the enlarged tubular end 10 of upper pole section 7 may be sleeved downwardly thereover to assume the closed assembled position of FIG. 2. A spring pressed ball 22 arranged at the lower end of enlarged end 10 projects inwardly and is adapted to be received within a detent 23 in section 2, below struts 18, and serves to retain the pole sections together, in an obvious manner. It will, of course, be understood that the fabric seat must be collapsed inwardly sufficiently to enable the enlarged end 10 of the upper pole section to be sleeved thereover so that the latter is concealed and stored therebetween.

The pole 1 is of standard ski pole length and is used in conjunction with a conventional rigid pole 24 of the same length as shown in FIG. 1. Assemblage of the upper and lower pole sections together in the position of FIG. 2 enables use of the pole 1 with pole 24 for skiing in the usual manner. When the skier desires to rest, the upper section 7 is unlatched and removed from lower section 2, and the upwardly folded or collapsed seating disc is moved downwardly and outwardly to the expanded position of FIG. 4 where it is retained in a position generally at right angles to the axis of lower pole section 2 by the hinged struts 15 and 18. By then inserting the pointed end of this section in the snow, the skier may rest thereon and use the other pole 24 as a prop or additional balancing support as shown in FIG. 1. While so resting on the seat, the removed upper pole section remains attached to the skier's wrist and to depend freely therefrom, or may be removed and disposed on the snow surface.

While a preferred embodiment has been illustrated and described, it is to be understood that various changes and improvements may be made therein without departing from the scope and spirit of the appended claims.

What is claimed:

1. A two-part ski pole including a pointed tubular lower shaft section and an upper tubular shaft section sleevably positioned thereon, flexible rimmed fabric seat disc means attached at the upper end of said lower section and foldable to a collapsed tubular position in alinement with said section and expandable to a generally circular seat forming position relative thereto, hinged strut means attachable to said seat disc means and to said upper tubular shaft section for supporting said seat means in expanded seat forming position, said upper section entirely concealing and housing said seat disc means when sleeved over the latter when collapsed and assembled on said lower section, and said upper section being removable therefrom.

2. In a device according to claim 1, wherein said seat means is open in its center and secured to ring means thereat.

3. In a device according to claim 2, wherein said strut means includes three spaced members hinged to said lower shaft section and to the rim of said seat means.

4. In a device according to claim 3, wherein said strut means additionally includes three spaced members hinged to said centrally arranged ring means and to said first mentioned spaced members at said rim whereby said seat means is supported in expanded seat position and is foldable into collapsed position for storage when said upper tubular section is sleeved thereover and said lower section.

5. In a device according to claim 1, wherein said upper tubular section is enlarged at its lower end for housing said collapsed seat means when sleeved thereover and said lower section.

6. In a device according to claim 5, wherein said enlarged lower end is formed with spring pressed closure means, and detent means is formed on said lower shaft section for coacting with said closure means for retaining said tubular sections in assembled position.

7. In a device according to claim 1, wherein spaced elongated slots are formed in the upper end of said lower shaft section, and strut means are hinged thereto so as to be received therein when said strut means and said seat means are in collapsed folded position.

* * * * *